United States Patent [19]

Pearce, Jr. et al.

[11] 3,999,095

[45] Dec. 21, 1976

[54] LAMP SOCKET AND BULB ASSEMBLY WITH SIDE CONTACTS

[75] Inventors: Warren Pearce, Jr., Warren; Charles W. Ramsey, Niles, both of Ohio

[73] Assignee: General Motors Corporation, Detroit, Mich.

[22] Filed: Oct. 6, 1975

[21] Appl. No.: 619,786

[52] U.S. Cl. ..... 313/318; 313/113; 339/91 L; 339/144 R; 339/248 S

[51] Int. Cl.[2] ..... H01J 5/48; H01J 5/50

[58] Field of Search ..... 313/318, 113, 313; 339/144 R, 145 R, 91 L, 176 L, 248 S, 252 R, 256 R

[56] References Cited

UNITED STATES PATENTS

| | | | |
|---|---|---|---|
| 3,017,599 | 1/1962 | Loesch | 339/144 R |
| 3,025,491 | 3/1962 | Hopkins | 339/176 L |
| 3,049,689 | 8/1962 | Clarkson | 339/176 L |
| 3,800,267 | 3/1974 | Burgess et al. | 339/176 L |
| 3,805,211 | 4/1974 | Moore | 339/176 L |

*Primary Examiner*—Saxfield Chatmon, Jr.
*Attorney, Agent, or Firm*—J. C. Evans

[57] ABSTRACT

A lamp socket and bulb assembly includes a socket having a generally rectangularly configured bulb opening and first and second side contacts to stabilize a bulb base against multiplanar reference walls in the socket; and wherein the base includes bulb filament contacts, spaced apart parallel reference surfaces and a pressure pad thereon all axially insertable into the socket to make electrical contact between the first and second side contacts and the bulb filament contacts, having a segment that exerts a force on the pressure pad to locate the parallel reference surfaces against one side wall of the socket and a curvilinear segment that engages an outwardly directed tab on the base to stabilize the base within the bulb opening by exerting a pull-in force thereagainst.

6 Claims, 6 Drawing Figures

LAMP SOCKET AND BULB ASSEMBLY WITH SIDE CONTACTS

This invention relates to lamp socket and bulb assemblies and more particularly to such assemblies wherein the bulb includes filaments that must be accurately optically aligned with respect to lamp housing components for distributing light therefrom.

Lamp socket and bulb assemblies for use as running lights on the front and rear of vehicles, and for use in signaling turn directions as well as stop indication, presently include a socket having a circular bulb opening therein with a J-slot to receive guide pins on a bayonet base portion of the bulb. In such arrangements it is necessary to apply a bulb insertion force in the order of thirteen pounds and thereafter twist the bulb into the J-slot of the socket to locate terminals within the socket in electrical contact with the base so as to complete an electrical circuit across the filaments thereof. Heretofore, such socket and bulb assemblies have been manually connected on wiring harness assembly lines.

While such socket and bulb assemblies are suitable for their intended purpose, they require a substantial bulb insertion force and are difficult to manufacture by an automatic assembly operation since the bulb must be both axially inserted and then twisted with respect to the socket to make electrical contact with the socket terminals.

Wedge base bulbs with rectangular cross-section bases are known. They fit axially into a socket with a pair of side contacts. The bulbs are typically utilized on printed circuit boards and the side contacts grip the base only at a midpoint thereon.

In both arrangements, the bulb base can wobble in the socket once it has been inserted in.

Accordingly, an object of the present invention is to provide an improved socket and bulb assembly which includes means for connecting a bulb base in a socket by means that permit axial insertion of the bulb base in a socket without requiring a twist motion of the bulb with respect to the socket and to do so while maintaining a stable relationship between the bulb base and the socket once it is inserted therein.

Still another object of the present invention is to improve a socket and bulb assembly for use in association with optical devices including precise alignment of a filament in the bulb with respect to lamp housing components by the provision of a socket having a generally rectangularly cross-section bulb base opening therein with a longitudinal reference surface formed on one side wall thereof and a transverse insertion index surface formed at the end thereof to receive a bulb base of rectangular cross-section having a side reference surface thereon and an axial index surface thereon for cooperation with the reference surfaces on the socket, the socket including a first side terminal contact having means thereon to electrically engage filament contacts on the base and to pull the base of the bulb axially into the socket and second means thereon to exert a pressure on the bulb base to hold it against the side wall reference surface of the socket and further including a second contact terminal on the opposite side of the bulb socket from that of the first contact terminal including means thereon electrically engageable with contacts on the bulb base to complete an electrical circuit across the lamp filaments.

Yet another object of the present invention is to configure the second side contact terminal of the preceding object for automatic insertion within a rectangular opening and wherein the second side contact includes plural free end portions each in engagement with one another to define a contact terminal without protruding lock tabs so the terminal can be automatically inserted into a socket contact hole and wherein the contact terminal has a segment thereon engageable by a tab portion of a socket cover which includes means thereon to fixedly secure the socket to a socket opening of a mounting panel.

Still another object of the present invention is to provide an improved bulb socket assembly including a socket having first and second side contact terminals each configured to electrically contact bulb contact filaments on a rectangularly configured bulb base insertable into electrical contact with the side contact terminals by application of an axial force on the bulb and wherein each of the sides contact terminals are configured for automatic insertion into rectangularly configured contact support openings in the socket, one of the contacts being arranged to electrically contact the bulb base longitudinally of one side thereof and wherein the other of the contacts has an axis arranged generally perpendicularly to that of the first contact bulb filament contact on the opposite side of the bulb base with the perpendicular relationship of the second contact maintaining a socket housing having a low profile, reduced socket extension length with respect to the mounting panel upon which it is located.

Further objects and advantages of the present invention will be apparent from the following description, reference being had to the accompanying drawings wherein a preferred embodiment of the present invention is clearly shown.

IN THE DRAWINGS

Figure 1:
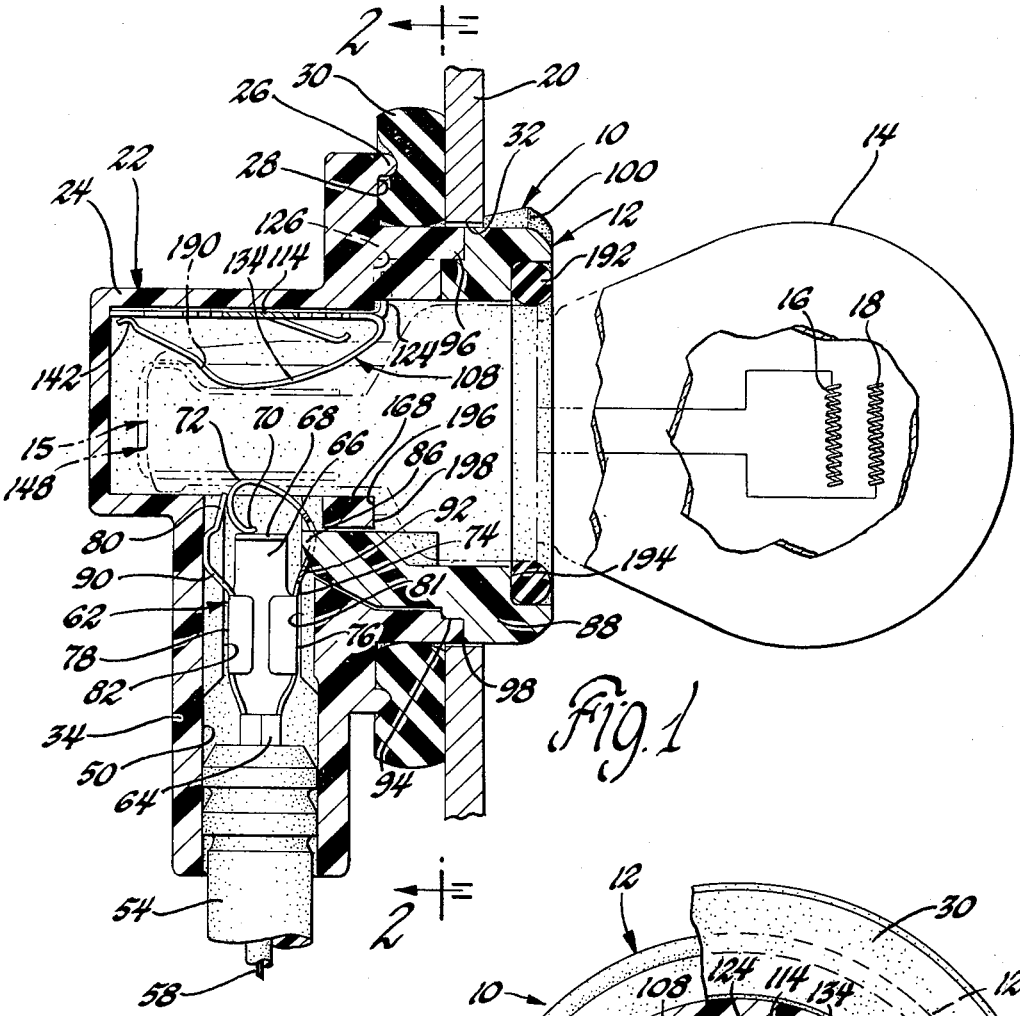
FIG. 1 is a vertical sectional view of a socket and bulb assembly of the present invention.

Referring now to the drawings, in FIG. 1, a socket and bulb assembly 10 includes a two-piece socket 12 and a bulb 14 of a lamp 15 which includes a major filament 16 and a minor filament 18 located on the center line of the bulb 14 and at a point slightly offset from the center line, respectively. These filaments are of a type which must be maintained in an accurate alignment with respect to optical components of a lamp assembly such as a parabolic reflector or a reflex lens to distribute light from the filament exteriorally of the lamp housing. Such lamps are especially suited for use in automotive lights such as front and rear lamp running lights, signal turning direction lights, safety parking lights and also as rear lights that produce a stop indication.

In such lamp applications it is desirable to configure the socket assembly 12 to occupy a limited space behind a mounting panel 20, a portion of which is illustrated in FIG. 1, representative of a sheet metal surface found on the exterior of automotive vehicles. To accomplish this purpose a first piece 22 of the two piece socket 12 is configured to have an inboard, rectangularly configured contact terminal housing portion 24 with a forwardly located, radially outwardly directed circumferential flange 26 thereon forming an annular seat 28 for a gasket 30 that is in sealing engagement with the inner surface of the mounting panel 20 around a socket mounting opening 32 therein. The axial extent of the housing portion 24 is minimized to maintain a low profile socket configuration which will occupy a limited space behind the mounting panel 20. This is made possible by the provision of an integrally formed, generally rectangularly configured side extension 34 on the socket piece 22 arranged generally perpendicularly to the longitudinal axis of the housing portion 24 and in close spaced relationship to the inner surface of the mounting panel 20 as shown in FIG. 1.

The extension 34 includes an opening 36 on one side thereof which receives an end portion of a wiring harness lead 38 that encloses an electrical conductor 40 connected to ground. The conductor 40 is electrically connected to a ground contact terminal 42 having a side rail 44 with a notch 46 therein that is secured to an integrally formed tab 48 on the inner surface of extension 34 to secure the ground contact terminal 42 to the socket 12.

The extension 34 further includes a pair of rectangularly configured cavities 50, 52 each receiving a wiring harness lead 54, 56 having electrical conductors 58, 60 directed therethrough connected to a power source.

Another feature of the present invention is the provision of a unique power contact terminal 62 located in each of the cavities 50, 52. The terminal 62 in cavity 50 will be described, it being understood that terminal 62 in cavity 52 has a like configuration. Each power contact terminal 62 includes a clamp collar 64 on one end thereof that connects to either the conductor 58 or 60. It includes an integrally formed side wall 66 thereon with a bent flange 68 on its end which underlies the tip 70 of a curvilinear spring contact 72 that is integrally formed at its opposite end 74 to a side wall 76 of the power contact terminal 62 located in spaced parallelism with an opposite side wall 78 that has an end extension 80 thereon in engagement with the spring segment 72. The side walls 76, 78 are received within a slot formed by opposed guide ridges 81, 82 in the cavity 50.

It will be noted that the three ends of the terminal 62 including the extension 80, spring contact 72 and stop flange 68 define a continuous surface on the power contact terminal 62 to permit straight-in automated insertion into the cavity 50. There is no protruding lock tang on the structure that interferes with such insertion.

Another feature of the present invention is provision of a slot 84 in the spring contact 72. It engages a retention tab 86 on a second part 88 of the two-piece socket 12 to prevent removal of the power contact terminal 62 from either the cavity 50, 52. Further interference against removal is provided at head 90 and head 92 of the guide which forms the surface 80.

The socket part 88 has an inboard, circumferential shoulder 94 formed thereon that is fixedly secured to a front facing flange 96 on the socket part 22. The parts 22, 88 have a circumferential outer surface 98 formed thereon which is axially insertable through the mounting opening 32 of the panel. Retention to the panel 20 is provided by a plurality of circumferentially spaced latch tabs 100, one of which is shown in FIG. 1, that will snap through the opening 32 and spread radially outwardly on the outer surface of the panel for holding the two-part socket 12 on the panel 20.

Each of the cavities 50, 52 are open to a generally rectangularly configured bulb base opening 102 formed in the housing portion 24. The opening 102 merges with a circular opening 104 extending through the forward end of the socket part 22 and the socket part 88. It will be noted that the power contact terminal 62 in each of the cavities 50, 52 extends inwardly of the opening 102.

The rectangular configured bulb base opening 102 also communicates with a side contact cavity 106 formed in the housing portion 24 on the opposite side thereof from the cavities 50, 52. The cavity 106 receives a ground contact terminal 108 located in opposite facing relationship to the spring contacts 72 which are spring biased into the opening 102 when the lamp 15 is removed therefrom. The maximum extent of the spring flexure of the contacts 72 into the opening 102 is shown in dotted lines in FIG. 2 at reference numerals 110, 112. The ground contact terminal 108 includes a base or support segment 114 that includes guide tangs 116, 118 at opposite sides thereof and smaller lead guide tangs 120, 122 thereon all of which fit in guide slots 123 in the sides of cavity 106. The base 114 further includes a retention flange 124 thereon that is seated in a slot 126 in the flange 26 as shown in FIG. 1.

Figure 2:
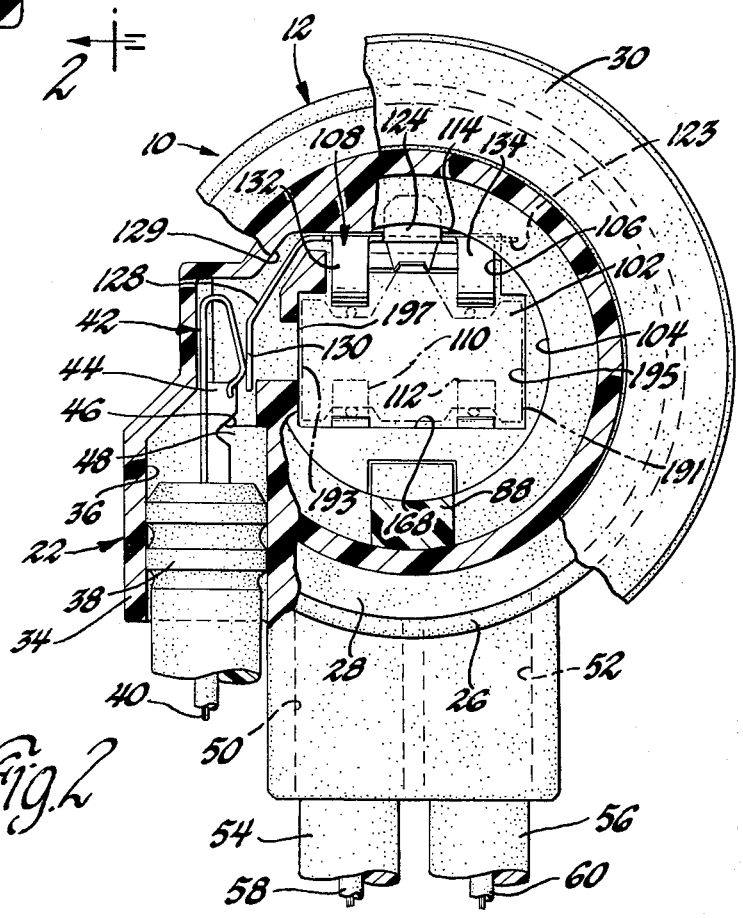
FIG. 2 is a sectional view taken along the line 2—2 of FIG. 1 looking in the direction of the arrow.
Figure 3:
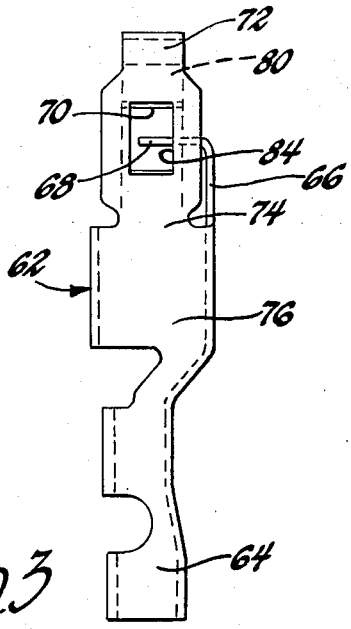
FIG. 3 is a front elevational view of one of the side contact terminals in the assembly of FIGS. 1 and 2.
Figure 4:
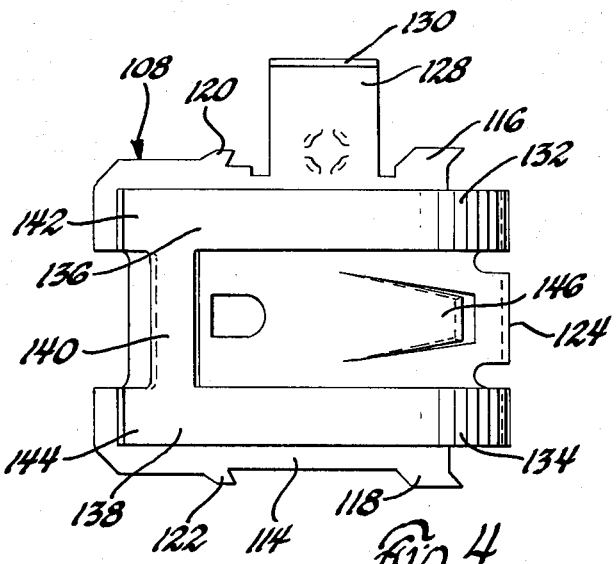
FIG. 4 is a bottom elevational view of a second side contact terminal in the assembly of FIG. 1.

A bent contact 128 on one side of the base 114 extends through a passage 129 in the side wall of the housing portion 24 and includes a free end portion 130 thereon in electrical contact with the bent end of the ground terminal 42 as shown in FIG. 2. The ground contact terminal 108 further includes a pair of spaced, parallel curvilinear spring contacts 132, 134 integrally formed thereon. They each include rebent segments 136, 138 in the vicinity of a cross member 140. They also each include tip portions 142, 144 each located in spring biased engagement with the inside surface of the base segment 114 as shown in FIG. 1.

Additionally the base segment 114 has a spring element 146 struck therefrom to extend inwardly of the opening 102. The aforedescribed configuration of the ground contact terminal 108 permits automatic insertion thereof into the cavity 106. The side mounted power contact terminals 62 and the oppositely located side mounted ground contact terminal 108 cooperate with a unique bulb base 148 on the lamp 15 which is configured to permit straight-in axial insertion into the bulb base opening 102. It is recognized, as set forth in the preamble material, that rectangularly configured wedge base bulbs are known on bulbs of a type used on printed circuit boards and the like. These types of bulbs include filament contact wires on the base. However, they are characterized by use of opposed spring biased wedge contacts that grip only a portion of the base generally at a central neck thereon to complete electrical connection to the filaments within the bulbs. Such prior known bulbs do not have requisite stability for locating and maintaining bulbs at a desired optical relationship with other portions of a lamp assembly. Furthermore, they have substantial wobble therein making the base configuration unsuitable for use in automotive applications.

In accordance with the present invention the opening 102 has specific wall portions thereon as does the bulb base 148 to establish multiplanar reference surfaces against which the bulb base 148 is spring biased and referenced by means of the terminal 108 to permit automatic assembly axial insertion of a bulb into a socket against reference surfaces where it is maintained in a spring biased relationship therewith to securely maintain the bulb in the socket 12 against wobble with respect thereto.

More particularly to accomplish these purposes, the unique bulb base 148 is configured to have a pressure pad 150 extending longitudinally on one side of the base 148 at a point intermediate a pair of contact filament wire grooves 152, 154. Each of these grooves receive a filament contact wire 156, 158 respectively having bent end portions 160, 162 thereon bent over the inboard end 164 of the base 148 at which point the wires 156, 158 enter the base. Each of the wires 156, 158 are ground wires leading from the major and minor filaments 16, 18 of the lamp 15.

Figure 5:
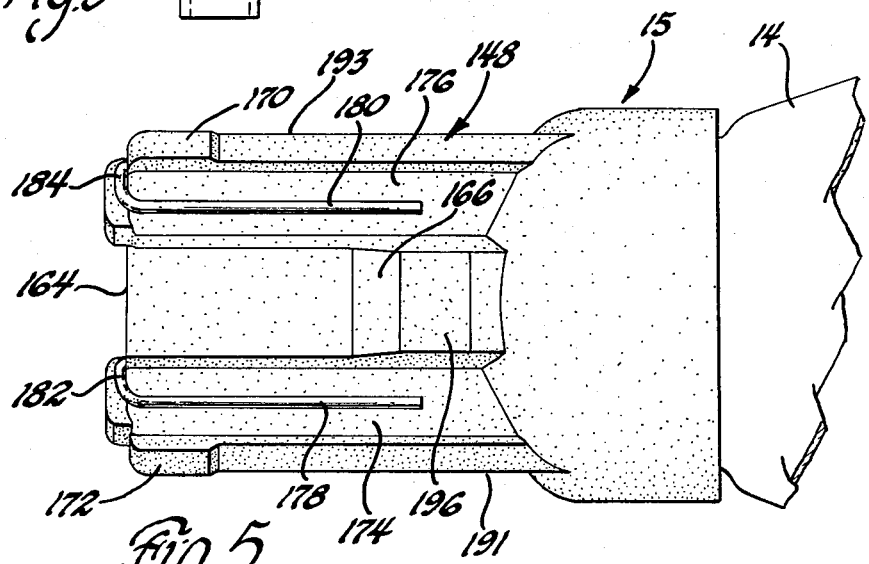
FIG. 5 is a bottom elevational view of a bulb base used in the present invention.

Base 148 further includes a reference surface 166 on the side thereof opposite from the pressure pad 150. The reference surface 166 engages a side wall reference surface 168 on one side of opening 102 to form one point of a three-point contact further defined by surfaces 170, 172 on either side of the underside of the base 148 as shown in FIG. 5. Surfaces 170, 172 also engage the reference surface 168 to define a stable platform of reference for the base 148 with respect to the reference surface 168. Also on the underside of the base 148 grooves 174, 176 are formed to receive filament contact wires 178, 180 respectively extending along the length of the base 148 into the bulb to make power contact with the major filament 16 and minor filament 18 respectively. Each of them are bent over at their end at 182 and 184 to be secured to the end 164 of the base.

Additionally, on the upper side of the base 148 as viewed in FIG. 1 a pair of spaced apart tabs 186, 188 are provided adjacent the end 164 each having an inclined surface 190 thereon. Spaced parallel sidewalls 191, 193 on the base are juxtaposed against sidewalls 195, 197 of opening 102 when the base is in place.

Figure 6:
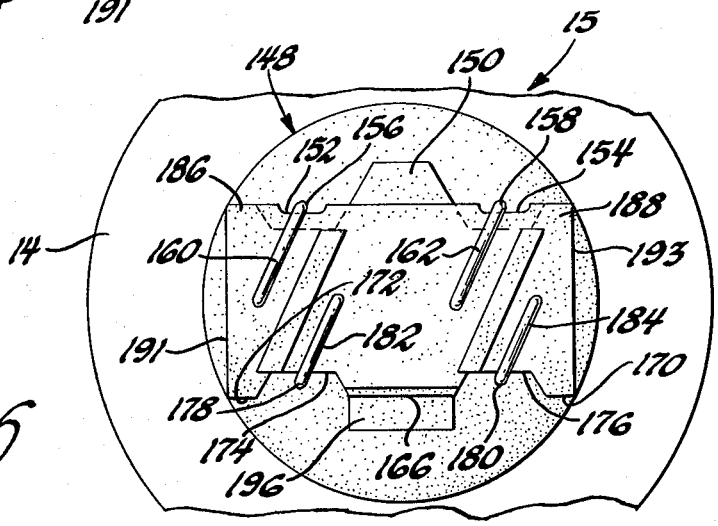
FIG. 6 is an end elevational view of the bulb base in FIG. 5.

By virtue of the aforedescribed structure of the base 148 as set forth with reference to FIGS. 5 and 6 the lamp 15 can be readily inserted into the bulb opening 102 from the open end 104 by a force of eight pounds as compared to thirteen pounds for bayonet base bulbs. The construction enables an annular O-ring 192 to be retained in a shoulder 194 of the latch portion 88 to seal the outboard in other bulb assemblies with respect to the socket 12. The bulb insertion by virtue of a design of the side contact terminals 62 and 108 and the specific configuration of a bulb base 148 enables the bulb assembly 14 to be easily inserted in a straight-in fashion without requiring a twist motion as in the case of bayonet base bulbs to retain the bulb assembly in place 14. Furthermore by virtue of the reference surfaces on the bulb assembly 148 and the surfaces at the opening 102, once the bulb assembly 14 is inserted into the opening 102 it will have greater stability than heretofore known wedge base bulb configurations with side contacts.

The curvilinear spring segments 132, 134 of the contact 108 will permit the base 148 to pass into the seated position at FIG. 1. At this point the segments 132, 134 will be spring biased into the grooves 152, 154 of the base 148 so as to electrically engage the ground filament wires 156, 158. At the same time the segments 136, 138 thereon will be biased against the surfaces 190 to exert an inwardly directed pull force on the bulb base to secure the lamp 15 against removal axially outwardly of the socket 12 unless a desired pull out force is exerted thereon. Furthermore the spring segment 146 of the contact 108 presses transversely of the base 148 at the pressure pad 150 to evenly distribute the pressure on the bulb base to the socket cavity wall reference surface 168 through the base reference surfaces 166, 170 and 172.

The pull-in action of the spring segments 136, 138 on the surface 190 also serves to locate a reference surface 196 formed on the base 148, perpendicularly with respect to the base reference surface 166, against a reference surface 198 formed perpendicular to surface 168 at the entrance to the bulb base opening 102 as best seen in FIG. 1. The combination of the perpendicularly arranged reference surfaces 168, 198 and the mating surfaces on the base 148 assure, accurate axial location of the filaments 16, 18 with respect to optical components of the lamp housing associated therewith. The flange 124 which carries the ground contact terminal 108 for automatic assembly operations into the socket 12 also traps the part in the socket to prevent its pull out on bulb removal.

When the bulb base 148 is inserted and biased by the contact terminal 108 the spring contact 72 of each of the oppositely located side power contact terminals 62 will be pressed outwardly of the bulb cavity from the dotted line position shown in FIG. 2 to the solid line position shown in FIG. 1. The flange 68 serves as a stop location for the spring contact 72 to prevent an overflex of these elements and further assures electrical contact between the terminals 62 and the filament contact wires 178, 180 as they extend longitudinally along the bottom of the base 148 as viewed in FIG. 1.

To remove the bulb assembly 14 a pull-out force is required to overcome the spring biasing action of the contacts 132, 134 on the surfaces 190. The spring 146 continues to exert a 90° force to the base 148 as the base is pulled out with respect thereto. The removal force is only necessary to overcome the pull-in force of the spring components, which is selected to assure proper seating of the base 148 with respect to the reference surfaces in the socket to assure accurate location of the filaments 16, 18 and to further prevent undesirable wobble of the bulb assembly 14 within the socket.

The aforedescribed structure overcomes the problem of having to manually insert bayonet base bulbs with guide pins thereon by axial and twist insertion movements. It further eliminates the wobble condition found between the J-configured retaining slot and guide pins on such bulbs and also overcomes the problem of wobble found in wedge base bulbs configurations having side contacts located at a mid contact point on the base of the bulb. Additionally, it permits automated assembly of the side contact terminals in the configuration. A further advantage is that the specific configuration reduces the overall length of the socket with respect to a mounting panel enabling it to be located within limited space arrangements found in present day lamp housings on automotive vehicles and the like.

While the embodiment of the present invention, as herein disclosed, constitutes a preferred form it is to be understood that other forms might be adopted.

What is claimed is:

1. A combination lamp socket and base assembly for use with a lamp having a bulb with a filament therein requiring alignment in a precise relationship to optical components of a lamp assembly comprising: a bulb base of polyhedron cross-section including a plurality of axially spaced parallel reference surfaces on one side of said base to define a three point reference platform thereon, a reference stop surface on said base formed transversely of said parallel surfaces, a pair of electrical contacts supported exteriorly of said base extending axially thereof, each contact being electrically connected to the bulb filament for supplying power thereacross, a lamp socket having means thereon for removably securing said socket to a panel at a socket opening therein, wall means in said socket defining a bulb base opening for axial insertion of said lamp base into said lamp socket, said wall means including a side wall surface having a first portion extending axially of and in parallelism to the longitudinal axis of said bulb base opening, said side wall surface including a second portion defining an insert stop surface engaged with said reference stop surface to limit axial insertion of said bulb base into said recess, said plurality of parallel reference surfaces located in juxtaposed alignment with said side wall surface to position the bulb filament along a first axis, said reference stop surface being in juxtaposed relationship with said second portion of said side wall surface to position the bulb filament along a second axis, a first electrical contact terminal including an axially extending support secured to said wall means, a curvilinear contact segment on said first contact terminal formed reversely of said support and disposed within said bulb base opening to engage the bulb base to apply a first resultant axial force thereon to pull said bulb base axially inwardly of said bulb base opening to stabilize the bulb filament along the first axis and to electrically mate with one contact of said pair of electrical contacts on said bulb base, a pressure spring on said first electrical contact terminal extending inwardly of said bulb base opening to engage another side of said bulb base to produce a second resultant force thereon generally transversely of said bulb base to bias the three point reference platform thereon into engagement with said side wall surface to stabilize the bulb filament along the second axis, and a second electrical contact terminal supported within said wall means including a contact segment thereon biased toward said bulb base into electrical contact with the other one of said pair of electrical contacts on said bulb base.

2. A combination lamp socket and base assembly for use with a lamp having a bulb with a filament therein requiring alignment in a precise relationship to optical components of a lamp assembly comprising: a bulb base of polyhedron cross-section including a plurality of axially disposed parallel surfaces on one side of said base to define a three point reference platform thereon, an index surface on said bulb base transverse to said parallel surfaces, a pair of electrical contacts supported exteriorly of said bulb base extending axially thereof, each contact being electrically connected to the bulb filament for supplying power thereacross, a lamp socket having means thereon for removably securing said socket to a panel at a socket opening therein, wall means in said socket defining a bulb base opening for axial insertion of said bulb base into said socket, said wall means including a side wall surface having a first portion extending axially of and in parallelism to the longitudinal axis of said opening, said side wall surface including a second portion defining an insert stop surface to limit axial insertion of said bulb base into said bulb base opening, said plurality of parallel reference surfaces being juxtaposed with said side wall surface to position the bulb filament along a first axis, said bulb base index surface being in juxtaposed relationship with said second portion of said side wall surface to position the bulb filament along a second axis, a first electrical contact terminal secured to said wall means, a first curvilinear segment on said first contact terminal disposed within said bulb base opening to engage said bulb base to apply a first resultant force thereon to pull said bulb base axially inwardly of said bulb base opening to stabilize the bulb filament along the first axis, and to electrically mate with one contact of said pair of contacts on said bulb base, a pressure spring on said first electrical contact terminal extending inwardly of said bulb base opening to engage another side of said bulb base to produce a second resultant force thereon generally transversely of said bulb base to bias the three point reference platform thereon into engagement with said side wall surface to stabilize the bulb filament along the second axis, a second electrical contact terminal supported within said wall means including a contact segment thereon biased toward said base into electrical contact with the other one of said pair of electrical contacts on said base, said second contact terminal having a retention slot therein, said socket having a latch finger thereon located within said slot on said second contact terminal to retain it on said socket.

3. A combination lamp socket and base assembly for use with a lamp having a bulb with a filament therein requiring alignment in a precise relationship to optical components of a lamp assembly comprising: a bulb base of polyhedron cross-section including a plurality of axially disposed parallel surfaces on one side of said base to define a three point reference platform thereon, an index surface on said bulb base transverse to said parallel surfaces, a pair of electrical contacts supported exteriorly of said bulb base extending axially thereof, each contact being electrically connected to the bulb filament for supplying power thereacross, a lamp socket having an axial portion including means thereon for removably securing said socket to a panel at a socket opening therein, wall means in said axial socket portion defining a bulb base opening for axial insertion of said lamp base into said socket, said wall means including a side wall surface having a first portion extending axially of and in parallelism to the longitudinal axis of said opening, said side wall surface including a second portion defining an insert stop surface to limit axial insertion of said bulb base into said bulb base opening, said plurality of parallel reference surfaces being juxtaposed with said side wall surface to position the bulb filament along a first axis, said bulb base index surface being in juxtaposed relationship with said second portion of said side wall surface to position the bulb filament along a second axis, said axial socket portion having a terminal cavity in one side thereof, a first electrical contact terminal secured in said terminal cavity, a first curvilinear segment on said first electrical contact terminal formed reversely and disposed within said bulb base opening to engage said bulb base to apply a first resultant force thereon to pull said bulb base axially inwardly of said bulb base opening to stabilize the bulb filament along the first axis, and to electrically mate with one contact of said pair of contacts on said bulb base, a pressure spring on said first electrical contact terminal extending inwardly of said bulb base opening to engage another side of said bulb base to produce a second resultant force thereon generally transversely of said bulb base to bias the three point reference platform thereon into engagement with said side wall surface to stabilize the bulb filament along the second axis, said socket having a side extension thereon extending perpendicularly to said axial portion and having a terminal cavity therein, a second electrical contact terminal supported within said side extension cavity including a curvilinear contact segment thereon biased toward said base into electrical contact with the other one of said pair of electrical contacts on said base, wiring harness leads connected to said side extension extending perpendicularly to said axial portion of said socket and including means for supplying power across said first and second electrical contact terminals.

4. A lamp socket for use with a lamp having a bulb with filament therein requiring alignment in a precise relationship to optical components of a lamp assembly the lamp having a rectangular base with a side surface having axial spaced points defining a planar reference platform, comprising: a lamp socket having means thereon for removably securing said socket to a panel at a socket opening therein, said socket having a housing with wall means defining a rectangular bulb base opening for axial insertion of a bulb base into said socket, said wall means including a flat side wall reference surface having a first portion extending axially of and in parallelism to the longitudinal axis of said opening, said reference surface including a second portion defining an insert stop surface to limit axial insertion of a bulb base into said recess, said housing having a side extension integrally formed thereon, wiring harness leads connected to said side extension to reduce the axial length of said socket, a side cavity in said housing formed opposite of said side extension, a first electrical contact terminal in said side cavity including a support secured to said wall means, a first curvilinear segment on said first contact terminal formed reversely of said support and disposed within said bulb base opening for engaging a bulb base to apply a first resultant force thereon to pull the base axially inwardly of said bulb base opening, a pressure spring on said first contact terminal extending inwardly of said bulb base opening for engaging the rectangular base to produce a second resultant force thereon generally transversely thereof to bias the planer reference platform thereon into engagement with said side wall reference surface, a second side cavity in said housing extending axially of said side extension, a second contact terminal supported within said second cavity including a curvilinear contact segment thereon to be biased into electrical contact with the bulb base.

5. A lamp socket having a housing with an axial extent including wall means to define a rectangular bulb base opening, said housing including a side extension with spaced parallel terminal cavities, one of said cavities having spaced parallel guide walls, a side terminal in said one cavity including a base and side walls supportingly received by said guide walls, a curved contact segment on said side terminal having a free end portion, one of said side walls having an end extension engageable with said contact segment to define an uninterrupted end surface on said side terminal to permit automated insertion thereof into said one cavity, means on said side terminal defining a stop flange to limit flexure of said contact segment axially toward said base, said side terminal having a slot therein, said socket having a latch finger thereon located within said slot on a second contact terminal to retain it on said socket.

6. A lamp socket having a housing with an axial extent including wall means to define a rectangular bulb base opening having multi-planar reference surfaces on one side thereof, a side extension on said housing having a first side contact terminal therein with a spring contact extending into said bulb base opening at said one side, means forming a terminal cavity in the axial extent of said housing at a second side thereof opposite to said one side, a second side contact terminal in said cavity including a base, integrally formed spaced, parallel spring contacts on said base extending into said bulb base opening at the second side, rebent segments on each of said spring contacts engageable with said base and adapted to engage a bulb base to exert a pull-in force therein, said base having a pressure spring thereon extending into said bulb base opening to exert a transverse force on a bulb base therein for producing alignment between the base and said reference surfaces, said base and rebent segments defining an uninterrupted end surface on said second side contact terminal to permit automated insertion thereof into said terminal cavity.

* * * * *